US008931926B2

(12) United States Patent
Becker et al.

(10) Patent No.: US 8,931,926 B2
(45) Date of Patent: Jan. 13, 2015

(54) REFLECTOR LUMINAIRE

(75) Inventors: Ralf Becker, Bad Gandersheim (DE); Harry Wagener, Alfed (DE); Marc C. Hubner, Einbeck (DE)

(73) Assignee: Auer Lighting GmbH, Bad Gandersheim (DE)

( * ) Notice: Subject to any disclaimer, the term of this patent is extended or adjusted under 35 U.S.C. 154(b) by 83 days.

(21) Appl. No.: 12/910,085

(22) Filed: Oct. 22, 2010

(65) Prior Publication Data

US 2011/0122631 A1 May 26, 2011

(30) Foreign Application Priority Data

Nov. 6, 2009 (DE) ..... 10 2009 053 207

(51) Int. Cl.

| | |
|---|---|
| ***F21V 7/00*** | (2006.01) |
| ***F21V 7/04*** | (2006.01) |
| ***F21V 7/09*** | (2006.01) |

(52) U.S. Cl.

CPC ... *F21V 7/04* (2013.01); *F21V 7/09* (2013.01); *F21V 7/005* (2013.01)

USPC ..... 362/297; 362/296.01; 362/299; 362/346

(58) Field of Classification Search

CPC ..... F21Y 2101/02; F21K 9/50; F21V 7/0025; F21V 7/0033; F21V 13/04; F21V 7/048; F21V 7/00; F21V 7/0083; F24J 2/10; F24J 2002/1014; G02B 6/0031; G02B 5/09; G02B 6/0055; G02B 6/2817; G02B 6/2848; F21S 48/13; F21S 48/1305; F21S 48/1323; F21S 48/1376; H01L 33/60; H01Q 15/14

USPC ..... 362/297, 299, 300, 301, 302, 308, 309, 362/310, 296.05, 296.06, 296.07, 296.08, 362/296.01–296.1, 235, 516, 346, 241, 243, 362/247, 328, 341, 350, 609, 604; 359/597; 257/98; 343/837, 912; 438/29

See application file for complete search history.

(56) References Cited

U.S. PATENT DOCUMENTS 3,112,893 A 12/1963 Crosby et al.
3,662,165 A * 5/1972 Osteen et al. ..... 362/297

(Continued)

FOREIGN PATENT DOCUMENTS

| | | | |
|---|---|---|---|
| DE | 202006003988 | U1 | 5/2006 |
| EP | 1 076 203 | A2 | 2/2001 |
| EP | 1209409 | A2 | 5/2002 |

OTHER PUBLICATIONS

European Search Report, Application No. EP 10013717 dated Dec. 9, 2010. p. 1.

*Primary Examiner* — Stephen F Husar
*Assistant Examiner* — Danielle Allen
(74) *Attorney, Agent, or Firm* — Duane Morris LLP

(57) ABSTRACT

A reflector luminaire with a light-emitting means and a reflector, which reflects light from the light-emitting means which is incident on said reflector in a predetermined emission direction and which has a rim (2) which points towards the emission direction makes it possible to perform particular lighting tasks, for example the uniform illumination of a rectangular illumination area by virtue of the fact that the reflector comprises a plurality of differently designed segments (7), which are calculated individually with respect to the light-emitting means for defined illumination of a predetermined area, and by the fact that the segments (7) are joined to one another by transition sections (8), by means of which the predetermined reflecting total surface area of the segments (7) is reduced by less than ¼.

14 Claims, 5 Drawing Sheets

(56) References Cited

U.S. PATENT DOCUMENTS

| | | | | | |
|---|---|---|---|---|---|
| 3,700,882 | A * | 10/1972 | Planchon | ..... | 362/298 |
| 4,021,659 | A * | 5/1977 | Wiley | ..... | 362/297 |
| 4,081,667 | A * | 3/1978 | Lewin et al. | ..... | 362/296.04 |
| 4,447,865 | A * | 5/1984 | VanHorn et al. | ..... | 362/305 |
| 6,080,464 | A * | 6/2000 | Gampe et al. | ..... | 428/131 |
| 2002/0051363 | A1 | 5/2002 | Arumugasaamy et al. | | |
| 2008/0055912 | A1 * | 3/2008 | Kittelmann et al. | ..... | 362/296 |

* cited by examiner

REFLECTOR LUMINAIRE

The invention relates to a reflector luminaire with a light-emitting means and a reflector, which reflects light from the light-emitting means which is incident on said reflector in a predetermined emission direction and has a rim which points towards the emission direction.

Such reflector luminaires are known in numerous embodiments. They serve the purpose of making the light emitted regularly in all spatial directions by the light-emitting means usable for illuminating a provided area or a corresponding solid angle. Therefore, not only the light which is emitted directly by the light-emitting means into this solid angle, but also the light emitted in other directions is used for the illumination, if this light passes to the reflector and is reflected by the reflector into the desired solid angle.

The invention is primarily concerned with reflector luminaires which are suitable for as uniform illumination as possible of an area which is perpendicular to the emission direction of the luminaire. For an arrangement of a plurality of reflector luminaires for illuminating a room, it is expedient here if the reflector luminaires have such an emission characteristic that the light from reflector luminaires with adjoining light cones is not made irregular by the fact that, firstly, there are excessive degrees of overlap between the light cones or, secondly, unilluminated sections arise between the light cones. However, attempts have been made to design reflector luminaires such that a rectangular area is illuminated as well as possible at a certain distance from the reflector luminaire because a uniformly illuminated total area can be formed by rectangular illuminated areas being arranged next to one another in a row.

Reflectors of reflector luminaires are generally produced from glass, for example using the compression process, by virtue of one side of the funnel-shaped or cup-shaped glass body being provided with a reflective coating. In this case, it is known both to coat the inner side of the glass body and to coat the outer side of the glass body. The coating can be formed by a metallic layer consisting of aluminum, silver etc. or can be produced as an interference layer which reflects visible light. In the latter case, there is the advantage that invisible thermal radiation can be allowed to pass through the reflector, which results in a so-called cold light source.

In known embodiments, surfaces of paraboloids or ellipsoids are selected for that area of the glass body which is provided as the reflective surface. In this case, ideally the light-emitting means is arranged at the focal point of the paraboloid if the emission of substantially parallel light is intended. The arrangement of the light-emitting means is ideally provided at a focal point of an ellipsoid if the light is intended to arrive focused at a specific point, namely at the second focal point of the ellipsoid. The generation of a reflective surface by a conic line can also be modified, however, in order to produce specific effects. Numerous attempts have been made to achieve as effective illumination as possible of a rectangular area with such an arrangement. However, as a result, an area has been illuminated which has a more elliptical shape and which is not optimal for uniform illumination of a total area by a plurality of such reflector luminaires. Accordingly, uniform illumination, for example of a sales area in a sales outlet, is only achieved to a certain degree since considerable differences in brightness with previous reflector luminaires are unavoidable.

The present invention is based on the object of designing a reflector luminaire of the type mentioned at the outset such that targeted illumination control, in particular uniform illumination, within an illuminated area which is perpendicular to the emission direction is possible with greater approximation.

In order to solve this problem, according to the invention, a reflector luminaire of the type mentioned at the outset is characterized by the fact that the reflector comprises a plurality of differently designed segments, which are calculated individually with respect to the light-emitting means for defined illumination of a predetermined area, and the fact that the segments are joined to one another by transition sections, by means of which the reflecting total surface area of the segments is reduced by less than ¼ in comparison with a conventional reflector with a continuous, unsegmented surface.

The present invention is therefore not based on an integral reflective body, but on a reflector body formed from a plurality of segments. In this case, each individual segment is calculated in terms of its shape with respect to the light-emitting means in order to emit, using this segment, a defined proportion of light to a defined position, with the result that a desired light distribution in the illumination plane is produced from the combination of the individual segments of the reflector. The segments of the reflector according to the invention in this case run with a continuous curvature in the region which is used substantially for the reflection. Accordingly, the desired light distribution, for example the illumination of a rectangular illuminated plane, is brought about by the shape of the segments and not, for example, by beveling of the reflective surface of the reflector body, as is known from EP 1 035 370 A1. Owing to the individual calculation of the segments, in the reflector according to the invention segments of different widths, different lengths and/or different curvature abut one another. This means that a stepwise transition results between the segments, at least partially, which transition is realized by narrow transition sections. The transition sections do not form an ideal step, for manufacturing reasons, but can produce a slightly rounded, step-like transition. The transition sections between the segments, when hit by the light from the light-emitting means, reflect the light in undefined directions. Since the transition elements are kept narrow such that they reduce the effective area of the segments which reflect in a defined manner by less than ¼, preferably less than ⅕, further preferably less than 1/10 and particularly preferably less than 1/20 in comparison with an integral reflector body, a corresponding light loss of less than ¼, preferably less than ⅕, further preferably less than 1/10 and particularly preferably less than 1/20 of the quantity of light in the region illuminated in a defined manner is produced for the effect of the area illuminated in a defined desired manner.

The segments can be aligned in any desired manner and can be joined to form the total reflector by means of the transition sections. If a reflector has a mid-axis, in which the light-emitting means is intended to be arranged, the segments can run substantially radially from the rim, which points towards the emission direction, in the direction of the mid-axis. However, it is also possible for at least some of the segments to be aligned tangentially with respect to the mid-axis and to adjoin one another.

In the case of the generally preferred radial alignment of the segments, identical segments can be arranged symmetrically with respect to the mid-axis, i.e. mirror-symmetrically with respect to one another. These segments running through the mid-axis can also be considered to be one segment, possibly interrupted by an opening in the mid-axis for accommodating a light-emitting means.

In a preferred configuration of the invention, the reflector luminaire forms a continuously shaped rim, and the segments are positioned such that they open out into the rim adjacent to one another. The rim is in this case preferably circular or is constantly slightly deformed with respect to a circular shape.

If the rim of the reflector is considered as the "front" rim, the light-emitting means can preferably be inserted into the reflector centrally from the rear. However, it is also possible for the light-emitting means to be allowed to protrude from the front or in particular through a lateral cutout or a lateral bore in the reflector body into the interior of the reflector.

Even if the reflector properties of the reflector according to the invention are determined by the shape of the segments, this does not exclude the possibility of the segments also having beveling over their longitudinal direction, for example radial direction, for example in order to provide a certain degree of softness of the light field generated. In this case, a slight modification is made to the light field already formed by the shape of the segments, but this modification does not alter the basic shape of the light field.

The reflector according to the invention preferably has segments with a horizontal contour (i.e. in the width direction in the case of strip-shaped segments) which is curved slightly, preferably parabolically. In the longitudinal direction (vertical direction) a shape is produced which results from the adaptation to the respective lighting task. The segments can also have a parabolic shape in the longitudinal direction if an illumination plane is intended to be illuminated uniformly, with the light-emitting means being positioned at the focal point of the respective paraboloid. In contrast to the conventional reflector bodies, however, the segments are not in the form of a paraboloid in the same way, but are matched to the shape of the illumination plane with different widths and different curvatures. Here, it is generally true that the width of the segments controls the quantity of light which falls into the region illuminated by this segment, while the curvature of the respective segment defines the illuminated region of the total illumination plane. If, therefore, a rectangular illumination plane is desired, the segments which are responsible for the light distribution into the corners of the rectangle need to be provided with a larger width, and therefore a greater quantity of light needs to be reflected into this region owing to the greater distance between the corner and the light-emitting means and owing to the thus greater proportion of the illumination plane.

It can be seen that, in a configuration of the invention, in which the segments are aligned radially, the radially opposite segments are calculated together in relation to the light-emitting means. If an illumination of the illumination plane which is symmetrical to the mid-axis of the reflector luminaire is desired, the opposite radial segments are equal, i.e. are provided with equal width and with equal curvature.

If, on the other hand, an asymmetrical illumination is desired, a formation of the segments which is asymmetrical to this extent results.

For reasons of visual aesthetics, it is preferred if the segments are joined to one another at a continuously curved rim and the segments also end at the rim at the same height. In this case, different lengths and curvatures of the segments towards the apex of the reflector body result in a "bled" structure, which is covered by a glass end piece, which is no longer of any significance for the reflection. In principle, however, it is also possible for the front rim of the reflector body to be designed to be bled if the segments have, for example at their radially inner end, on an identical radial start point.

Although the reflector body according to the invention comprises numerous, individually calculated segments, it is produced as such as an integral reflector body. For reasons of ease of production, for example using a compression process, it may also be expedient not to form the segments at the same height at the ends, but somewhere in a central region with respect to the length of the segments.

The invention will be explained in more detail below with reference to an exemplary embodiment illustrated in the drawing, in which.

Figure 1:
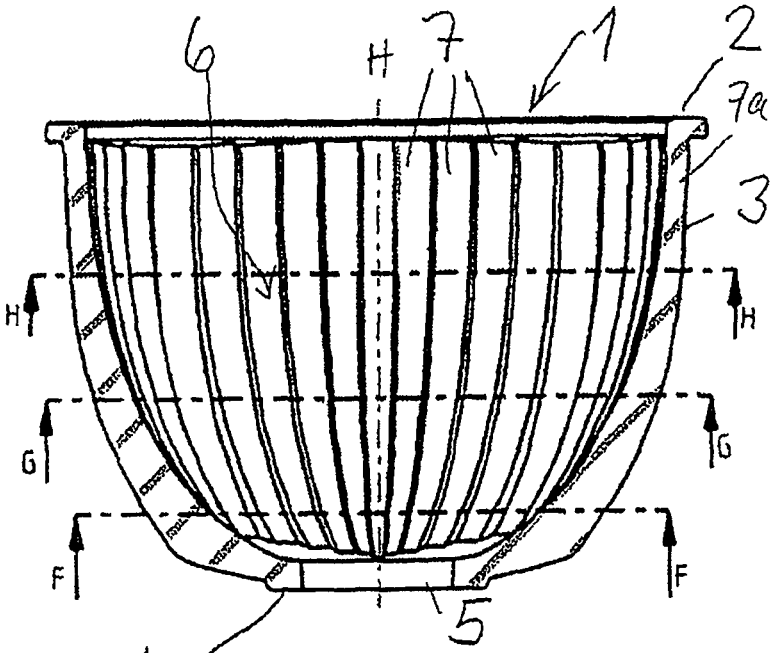
FIG. 1 shows a vertical section through an exemplary embodiment of a reflector according to the invention.

The embodiment illustrated in the drawing of a reflector according to the invention shows a reflector which is formed on an outer side with circular symmetry around a vertical axis H and which therefore has a circular exit opening 1, which is delimited by a flange-like rim 2 in the form of a circular ring. Starting from the flange-like rim 2, the reflector is designed to be continuous on its outer side 3 and represents a conventional reflector dome on the outer side which merges with an apex area 4 on the lower side. A central through-opening 5 is located in the apex area 4, with a light-emitting means protruding through said through-opening into the interior 6, formed by the reflector dome, of the reflector in the embodiment illustrated. It can be seen from FIG. 1 that the interior 6 is delimited by radially aligned, strip-shaped segments 7, which form a common, irregular inner wall of the interior 6. In the embodiment illustrated, the segments 7 are designed to be mirror-symmetrical with respect to the vertical axis H, as is also illustrated in the plan view of the inner side of the reflector shown in FIG. 2.

Figure 3:
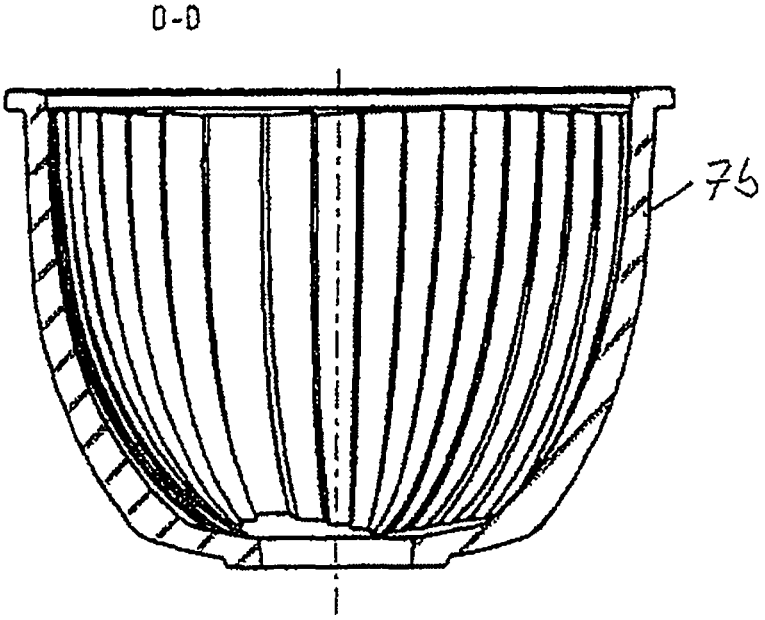
FIG. 3 shows a vertical section along the line D-D in FIG. 2.
Figure 4:
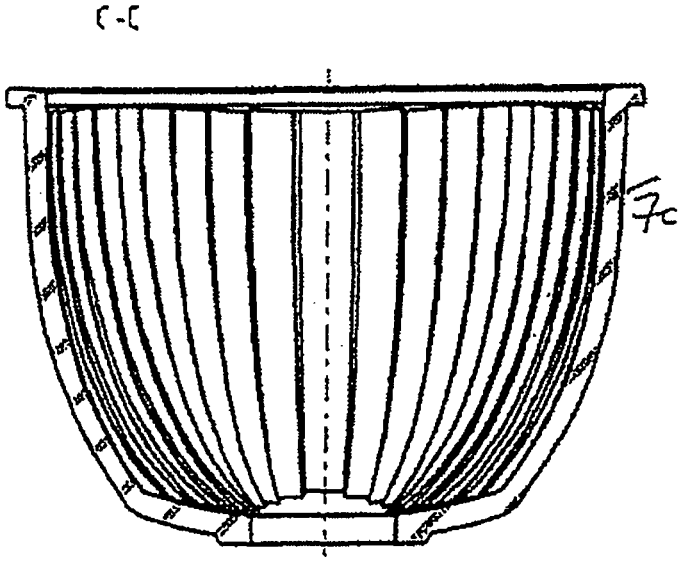
FIG. 4 shows a vertical section along the line C-C in FIG. 2.

The vertical sections illustrated in FIGS. 3 and 4 through various segments 7 illustrate the different design of the segments 7 in comparison with those in FIG. 1. The respective segments 7 illustrated in section have, in FIG. 1, a much greater material thickness towards the apex area 4 than those which are illustrated in section in FIG. 3. The segments 7 illustrated in section in FIG. 4 are designed to have an even further reduced material thickness towards the apex area 4 in comparison.

Figure 2:
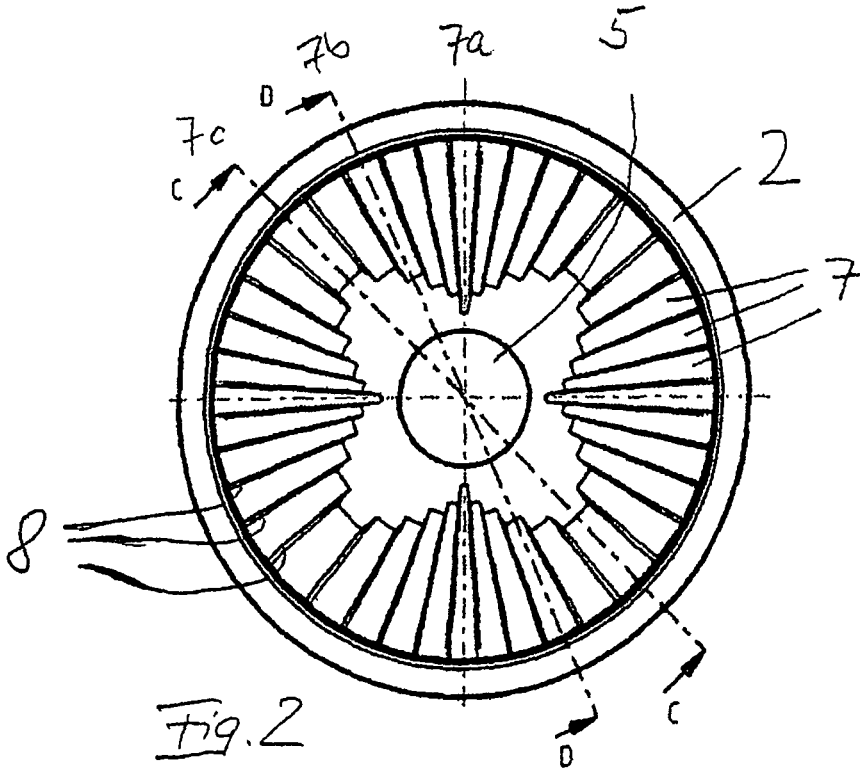
FIG. 2 shows a view of the reflector from below, i.e. a view of the free rim and the inner reflective areas of the reflector.

The illustration shown in FIG. 2 shows that the segments 7 of the illustrated embodiment are designed in such a way that uniform illumination of a rectangular area which is perpendicular to the vertical axis H is achieved. Accordingly, the segment 7*a* illustrated in sectional form in FIG. 1 is provided with a greater curvature than the segment 7*b*, which is spaced apart here at approximately 22.5 angular degrees and is illustrated in section in FIG. 3. The segment 7*c*, which is illustrated in section in FIG. 4 and is responsible for the illumination of the corners of the rectangular illumination area has the smallest curvature. The segment 7*c* therefore needs to focus the light arriving from the light-emitting means to a lesser extent and distribute it over a greater distance than the segment 7*a*, which is intended to deflect the light from the light-emitting means to a relatively small solid angle for closer illumination. Since the segment 7*a* distributes the light from the light-emitting means at a smaller solid angle than the segment 7*c*, the segment 7*a* is designed to be much narrower than the segment 7*c*. This means that, at the smaller solid angle which is illuminated by the segment 7*a*, the luminance produced is no greater than at the larger solid angle, which extends as far as the corner of the rectangular illumination area and is illuminated by the segment 7*c*. The segment 7*b*, as can be seen from the figure, is between segments 7*a* and 7*c* as regards the focusing effect (curvature) and segment width. The different segments 7 are joined to one another by narrow transition sections 8.

Figure 5:
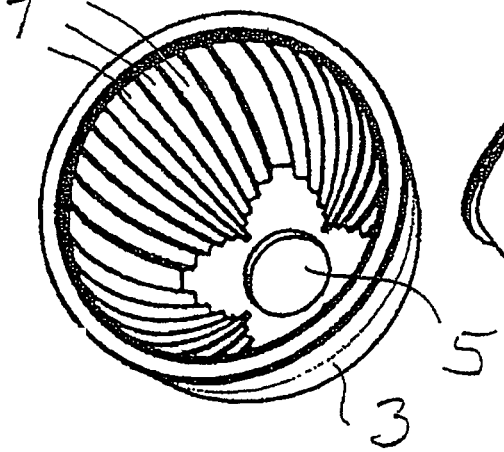
FIG. 5 shows a perspective view of the reflector shown in FIG. 1 at an angle from below.
Figure 6:
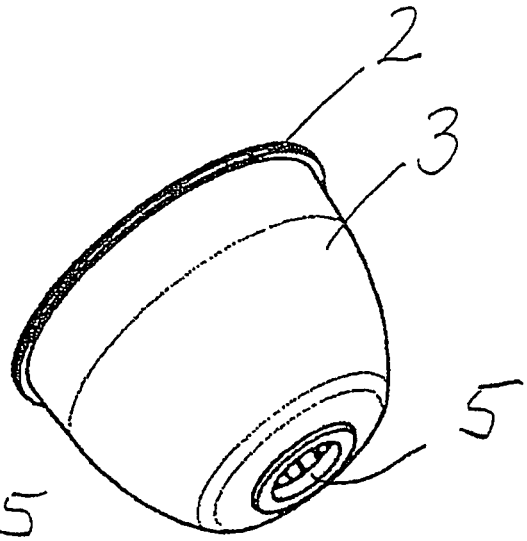
FIG. 6 shows a perspective view of the reflector at an angle from above.

The sectional illustrations show, as do the perspective illustrations in FIGS. 5 and 6, how the segments are formed on the inner side of the reflector dome, while the outer side 3 can be in the form of a smooth, continuous glass area.

Figure 7:
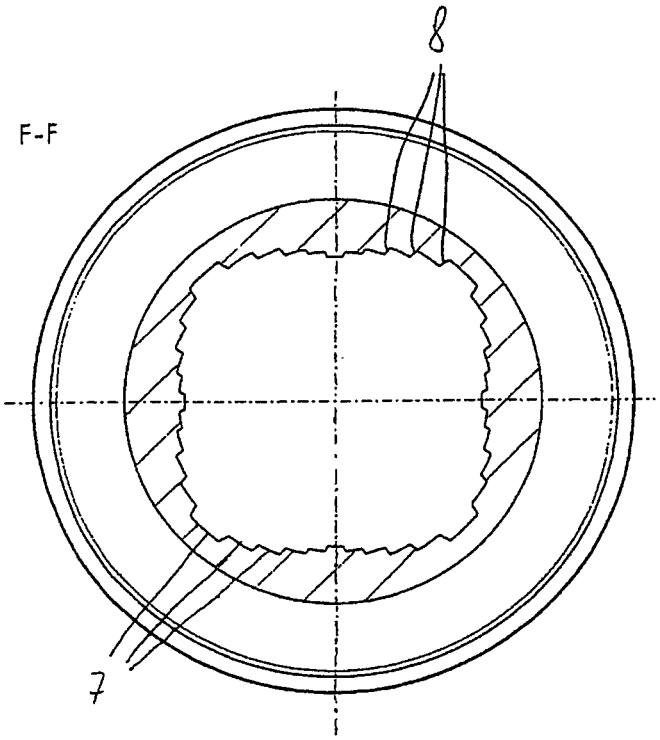
FIG. 7 shows a horizontal section through the reflector in the plane F-F shown in FIG. 1.
Figure 8:
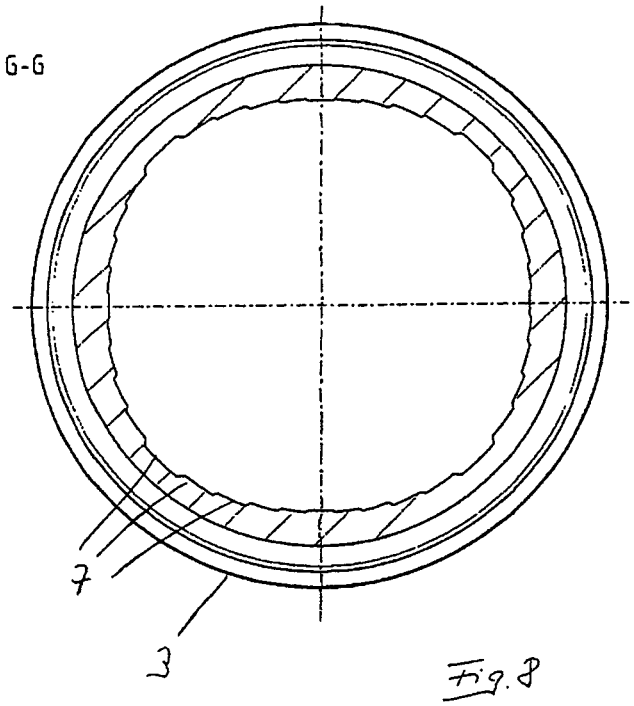
FIG. 8 shows a horizontal section through the reflector in the plane G-G from FIG. 1.
Figure 9:
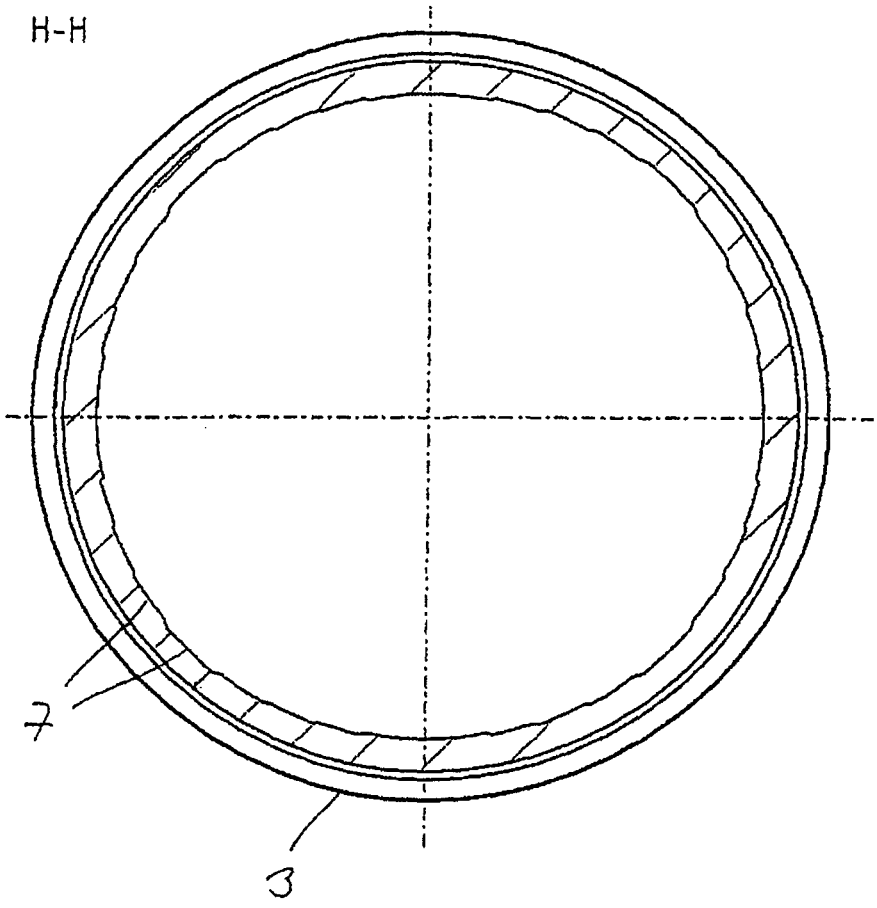
FIG. 9 shows a horizontal section through the reflector in the plane H-H from FIG. 1.

This relationship is particularly noticeable from the different horizontal sections in FIGS. 7, 8 and 9. It can be seen that the differences between the segments 7 in the section F-F close to the apex area 4 are markedly greater than in the section G-G which is at approximately half the height, while an approximation of the segments 7 in the region of the section H-H, which is further towards the rim, are further reduced in size, with the result that the segments 7 at the rim 2 itself continuously adjoin one another. The transition sections 8 which are not taken into consideration for the calculation of the distribution of the useful light by the segments 7 can clearly be seen here.

This design of a reflector according to the invention is not absolutely essential, but results from the continuous rim 2 being introduced as a boundary condition in the calculation of the shape of the segments 7. The shape of the segments 7 is calculated individually in order to fulfill the specific lighting task. If the continuous connection of the segments 7 to the rim 2 is predetermined as a boundary condition, the "bled", i.e. non-uniform terminations of the segments 7 in the apex region of the reflector dome or spherical cap shown in FIG. 2 are produced. In order to form a reflector which is easy to handle, the apex region is provided with a smooth glass shape, in which the through-opening 2 is formed.

It is of course possible to calculate the segments 7 also using other boundary conditions, for example allowing the segments to begin in the region of the opening 2 such that a nonuniform formation of the rim 2 of the reflector results. Furthermore, intermediate forms are possible which result from the respective boundary conditions.

The lighting task of the uniform illumination of a rectangular area which is perpendicular to the vertical axis H of the reflector has been explained with reference to the illustrated embodiment. The invention is naturally not restricted to this lighting task since the segmented design of the reflector enables any desired shapes for the illuminated area. The exemplary embodiment is also based on the fact that the segments are each substantially parabolic and that the light-emitting means is located approximately at the focal point of the respective parabolas, with the result that uniform illumination with only a small amount of light deviating from the parallelism results. It is of course also possible within the scope of the invention to provide targeted focusing of the light, with the result that approximately elliptical segments are used. In principle, the shape of the segments is free, however, and results from the determination of the optimized shape for each segment 7 from the respective lighting task. The individual segments therefore regularly form free-form reflectors.

The exemplary embodiment illustrated is based on radially arranged segments 7 in a substantially rotationally symmetrical reflector dome.

Other reflector shapes are of course likewise suitable for the design according to the invention of the reflector with segments. For example, the outer side of the reflector can also be designed to have an oval cross section. In addition, the invention makes it possible for the illuminated area to have a particular shape in the case of cylindrical reflectors which are part of a long-range luminaire and interact with a long-range illumination means, for example a glow discharge lamp, in particular in the form of a neon tube. In this case, the segments are preferably arranged parallel to one another and extend transversely with respect to the longitudinal direction of the cylindrical reflector.

In addition, with a reflector according to the invention, desired nonuniform illumination of an envisaged area which furthermore can also have any desired shape is also possible. The boundaries of the illuminated area can in this case also be non-linear, continuously curved or non-continuously shaped.

The invention claimed is:

1. Reflector luminaire with a light-emitting means and a reflector, which reflects light from the light-emitting means which is incident on said reflector in a predetermined emission direction and has a rim which points towards the emission direction, said reflector comprising:

a plurality of differently designed segments each consisting of a single curved facet, said segments being aligned radially and symmetrically with respect to a mid-axis of said luminaire such that all segments run substantially radially from the rim in the direction of the mid-axis and which run with a continuous curvature in the region used for the reflection, said segments being calculated individually with respect to the light-emitting means in terms of their shape, namely their width, length and curvature for defined illumination of a predetermined area; and a plurality of transition sections joining adjacent segments, wherein the predetermined total reflecting surface of said segments comprises more than seventy-five percent of the total surface area of the reflector.

2. Reflector luminaire according to claim 1, wherein the segments are designed for joint uniform illumination of an area within a defined contour.

3. Reflector luminaire according to claim 1 or 2, wherein the segments are arranged so as to be offset stepwise with respect to one another.

4. Reflector luminaire according to claim 1, wherein the segments together form a rim having a continuous shape.

5. Reflector luminaire according to claim 1, wherein the light-emitting means is surrounded completely by the reflector in a plane which passes through said light-emitting means and is perpendicular to the emission direction of the luminaire.

6. Reflector luminaire according to claim 5, wherein a rim of the reflector is arranged at a distance from the light-emitting means in the emission direction.

7. Reflector luminaire according to claim 2 wherein the segments together form a rim having a continuous shape.

8. Reflector luminaire according to claim 3 wherein the segments together form a rim having a continuous shape.

9. Reflector luminaire according to claim 2, 4, 7 or 8, wherein the light-emitting means is surrounded completely by the reflector in a plane which passes through said light-emitting means and is perpendicular to the emission direction of the luminaire.

10. Reflector luminaire according to claim 4, 7 or 8, wherein the rim is designed to be circular, when viewed in the direction of the mid-axis.

11. Reflector luminaire according to claim 4, 7 or 8, wherein the rim is slightly deformed continuously with respect to a circular shape.

12. Reflector luminaire according to claim 1 wherein the curvature of at least one segment varies along the length of said segment.

13. Reflector luminaire according to claim 12 wherein a plurality of segments have differently varying curvatures along the length of said segment.

14. Reflector luminaire comprising:

a light source positioned at a mid-axis of the luminaire; and a reflector positioned radially and symmetrically about the mid-axis of the luminaire for reflecting light emitted by said light source in a predetermined direction, said reflector comprising:

a rim; and a plurality of segments, each segment consisting of a single curved facet extending from said rim radially toward the mid-axis of the luminaire, each of said segments having a different width, length and curvature relative to the other segments among said plurality of segments; and a plurality of transition sections joining adjacent segments, wherein the predetermined total reflecting surface of said segments comprises more than seventy-five percent of the total surface are of the reflector.

* * * * *